United States Patent [19]

Goitia

[11] 3,950,872

[45] Apr. 20, 1976

[54] TOY FILM VIEWER

[75] Inventor: Felix Oginaga Goitia, Zaragoza, Spain

[73] Assignee: Nacoral, S.A., Zaragoza, Spain

[22] Filed: Aug. 28, 1974

[21] Appl. No.: 501,048

[30] Foreign Application Priority Data

May 16, 1974 Spain ..... 203094

[52] U.S. Cl. ..... 40/96; 40/106.1

[51] Int. Cl.[2] ..... G09F 11/26

[58] Field of Search ..... 40/96, 96.5, 86 A, 63 A, 40/106.1

[56] References Cited

UNITED STATES PATENTS

| | | | |
|---|---|---|---|
| 2,520,410 | 8/1950 | Jelinek | 40/96 |
| 3,264,051 | 8/1966 | Melton | 40/86 A X |

*Primary Examiner*—John H. Wolff

*Attorney, Agent, or Firm*—Eyre, Mann, Lucas & Just

[57] ABSTRACT

A toy film viewer is disclosed. The viewer comprises film wound on an endless spool and a crank driven set of gears which are capable of moving the film past the viewing portion of the viewer. The viewer further comprises a device which abruptly alters the rate of forward movement of the film and thereby gives the characters printed on the film the impression of motion. The altering device comprises a leader for tensioning the film followed by a spring loaded pivot arm having cylinders thereon which engage the film. The rate of forward movement of the film past the viewing portion of the viewer is altered as the spring tension and film tension intermittently pivot the pivot arm and thereby move the engaged film abruptly past the viewing portion.

4 Claims, 8 Drawing Figures

TOY FILM VIEWER

Both film and slide or similar projectors require a screen on which to project as well as a considerable reduction in room lighting where showing is to take place. This invention introduces a number of advantages eliminating the aforementioned disadvantages.

SUMMARY OF THE INVENTION

This invention consists of a viewer made up of a parallelepiped rectangular and square-topped internally hollow casing, with the viewer portion set solidly on one of the casing's lesser sides.

The inside of the casing houses the film or tape wound on an endless reel or spool, and a set of cogwheels which are crank-driven from outside. The cogs or projections on the wheel are inserted in the side or tracking film perforations and cause its forward travel through the viewer upon rotation of a crank. The viewer is fitted with corresponding lenses.

This toy viewer is fitted with a device giving the viewer the impression that both actors and objects printed on the film are moving.

The device in question consists of an arm pivoted at one of its ends on a shaft fitted with a backspring, while at the opposite end there is a body formed by several small cylinders of varying diameter one above the other.

This device feeds or tracks the film, providing very fast small and sharp feeds, thus providing the aforementioned impression of motion.

DETAILED DESCRIPTION OF THE PREFERRED EMBODIMENTS

Figure 1:
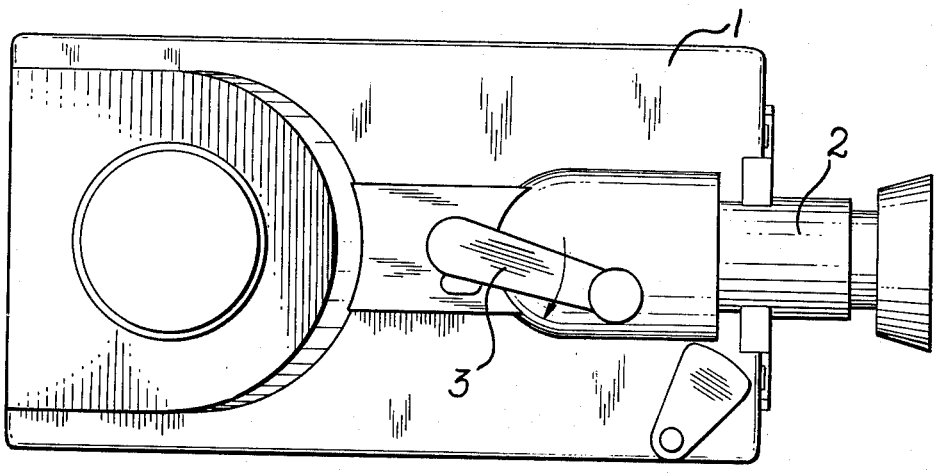
FIG. 1 is a left side view of the viewer according to the invention.
Figure 2:
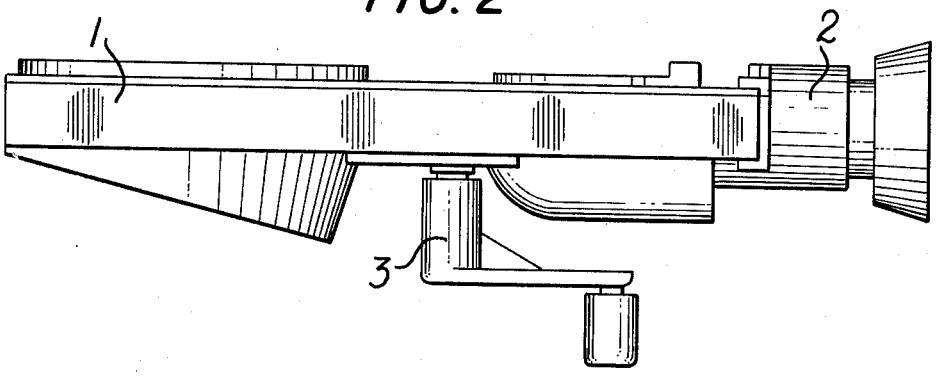
FIG. 2 is a top view of the viewer shown in FIG. 1, showing the crank position.
Figure 3:
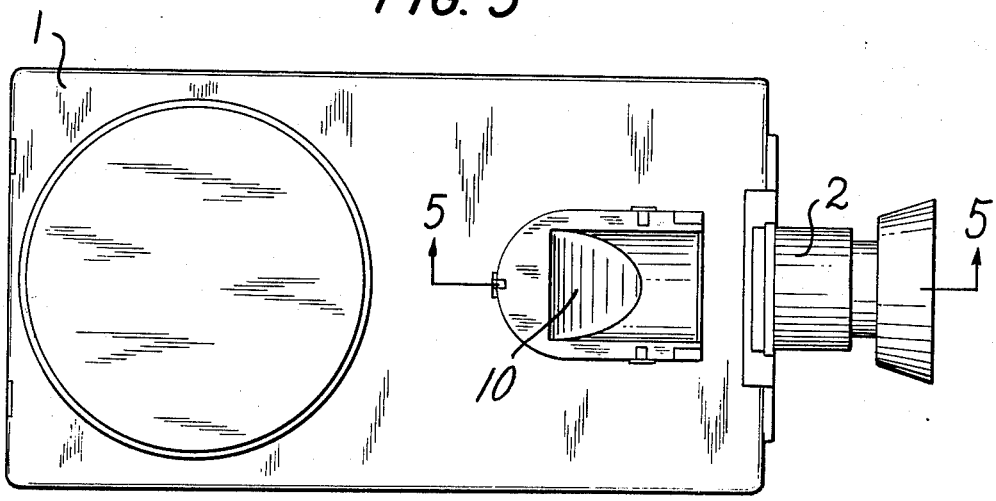
FIG. 3 is a right side view of the viewer shown in FIG. 1 in which it is possible to see the aperture through which light rays impinge on the viewer cavity.
Figure 4:
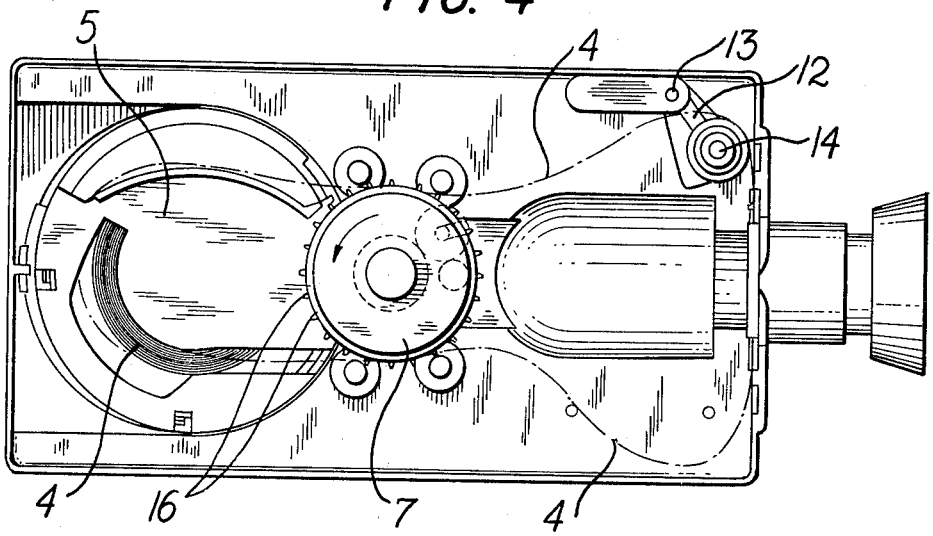
FIG. 4 shows a longitudinal section of the viewer apparatus of FIG. 1, particularly showing the position occupied by the film spool or roll, feed or tracking wheel, viewer guide or leader, the motion-producing device, and the path taken by the film.
Figure 5:
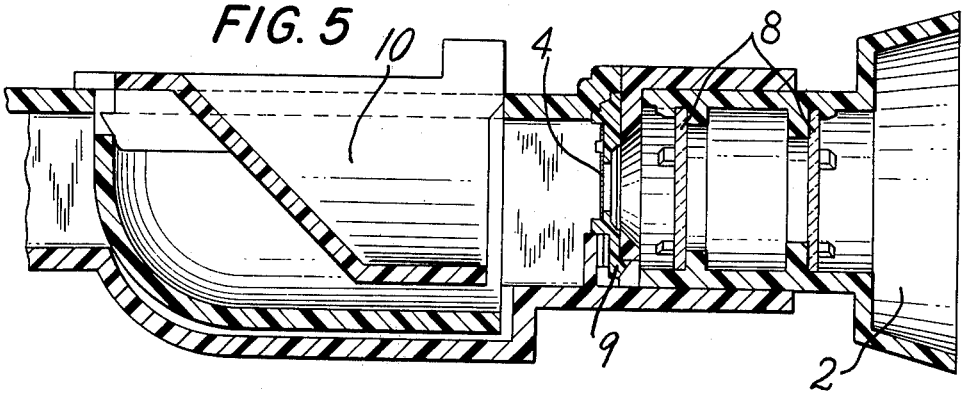
FIG. 5 is a blown-up sectioned detail taken along line 5—5 of FIG. 3.
Figure 6:
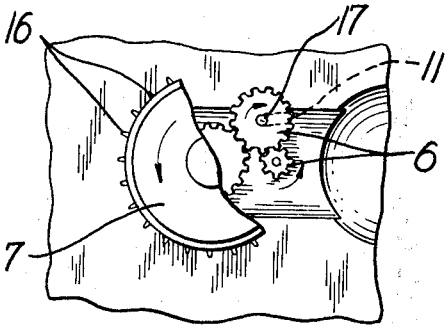
FIG. 6 is a partial blow-up detail of the toothed driving wheels of the tracking or feed wheel.
Figure 7:
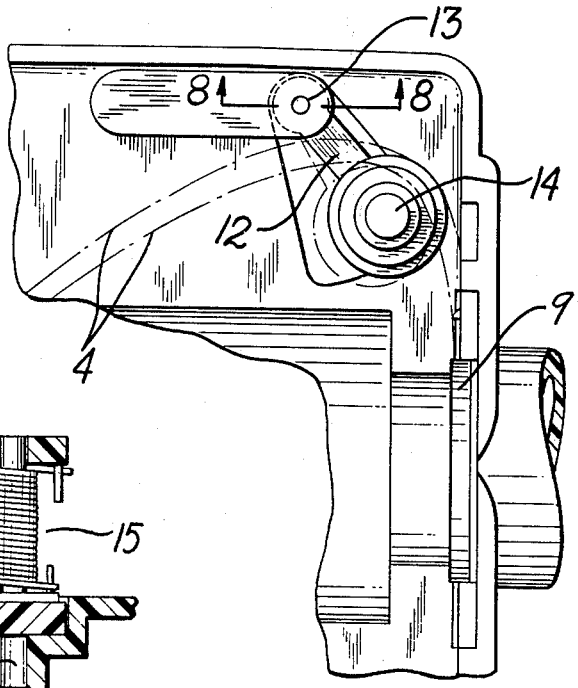
FIG. 7 is a blow-up detail of the motion-producing device.
Figure 8:
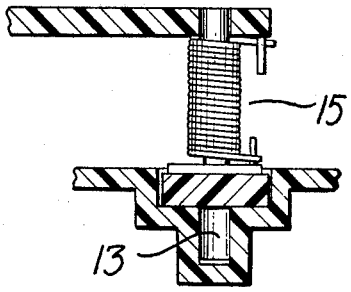
FIG. 8 is a sectioned detail of the rocker body shaft taken along line 8—8 of FIG. 7.

The toy film viewer is made up of a main parallelepiped hollow body comprising the case 1 into one of whose lesser sides the viewer 2 is solidly fitted.

Inside the aforementioned case 1 are at one end the endless spool 5 carrying the film 4; in the mid-area, crank 3 drives cogwheels 6 which in turn drive the feed or tracking wheel 7 whose cogs 16 are inserted in the tracking slots or perforations which feed the film 4; and at the other end are the viewer 2 and rocker piece or pivot arm 12.

The intermediate cogwheel 6 has its shaft 17 housed in the cavity of a slotted hole 11 so that if an attempt is made to turn the crank 3 in the direction opposite to that producing film forward motion, the turning direction of the aforesaid intermediate wheel 6 is reversed and its own effort gives rise to its shaft 17 sliding into the cavity of the slotted orifice 11, preventing runback of the film 4.

The viewer 2 has its matching lenses 8 and a lighting port or aperture 10 arranged laterally in the case 1 and a leader 9 through which the film 4 runs snugly, positioning it in front of the aforementioned lenses 9.

The device causing the impression of motion is positioned at one of the upper corners of the case 1 consisting of a rocker-piece 12 pivoted at one of its end on a shaft 13 with a backspring 15 and fitted with cylinders 14 of differing diameters one above another at the opposite end, on which the film 4 rests.

Using the crank 3 the cogwheels 6 are set in motion, these in turn rotating the feed or tracking wheel 7 so bringing about feeding or tracking of the film 4, which then passes thru the leader 9 of viewer 2 and thence to the cylinders 14 of rocker-piece 12, continuing until again reaching the endless spool 5 on which it is wound.

To provide the impression of motion of objects printed on the film 4, the viewer apparatus is fitted with the motion device described in previous paragraphs its operation being as follows: upon turning the crank 3 which causes film 4 to feed, the film is tensioned due to its tracking through the leader 9, and is drawn tight as it lies on the cylinders 14 of the rocker piece 12 during its travel; this causes the rocker detail to turn on its shaft 13, initially overcoming the backspring 15 until this spring reaches a specified tension above that exercised by the film 4, at which time it suddenly returns the aforesaid rocker-piece 12 to its inoperative position, thus causing sharp forward feed of the film 4. Since this operation is carried out continuously and rapidly and the film 4 feeds are of short length, this brings about the impression that people and things printed on the film are in motion.

I claim:

1. In a toy film viewer comprising a hollow body having viewing means and moving means for moving film thereby, altering means for abruptly altering the rate of forward movement of film past said viewing means, said altering means comprising:

a. means for tensioning the film;

b. pivot means positioned upstream of said tensioning means relative to the direction of forward film movement, said pivot means including engaging means for slidably engaging the film and urging means for urging and moving the engaging means in a first pivoted direction, said pivot means being operative to be moved in a pivoted direction opposite to said first pivoted direction when the film tension overcomes said urging means, thereby being operative to abruptly move said engaging means and the film back into said first pivoted direction when the urging means overcomes a predetermined film tension; and c. preventing means for preventing reverse movement of the film.

2. The film viewer according to claim 1, wherein said moving means comprises a plurality of shafts and meshing gears mounted thereon, and said preventing means includes a cavity positioned adjacent one of said shafts, said one shaft being operative to slide into said cavity when the film is attempted to be moved in the reverse direction.

3. The film viewer according to claim 1, wherein said pivot means comprises a pendent shaft and a pendent rocker jib mounted thereon, and said urging means comprises a coil spring and end pieces positioned at opposite ends on said pendent shaft, said coil spring being mounted on said pendent shaft to engage said end pieces at opposite ends of said coil spring, said arrangement being operative to urge said rocker jib in said first pivoted direction.

4. The film viewer according to claim 3, wherein said engaging means comprise a plurality of cylinders of different diameter mounted concentrically on said pendent jib and operative to slidably engage said film.

* * * * *